US007148615B2

(12) United States Patent
Tojo et al.

(10) Patent No.: US 7,148,615 B2
(45) Date of Patent: Dec. 12, 2006

(54) COLOR CATHODE RAY TUBE

(75) Inventors: Toshio Tojo, Ichinomiya (JP); Norikazu Uchiyama, Chikura (JP)

(73) Assignee: Hitachi Displays, Ltd., Chiba-ken (JP)

( * ) Notice: Subject to any disclaimer, the term of this patent is extended or adjusted under 35 U.S.C. 154(b) by 0 days.

(21) Appl. No.: 10/775,637

(22) Filed: Feb. 10, 2004

(65) Prior Publication Data

US 2004/0178717 A1 Sep. 16, 2004

(30) Foreign Application Priority Data

Mar. 13, 2003 (JP) ..... 2003-068099

(51) Int. Cl.
*H01J 31/00* (2006.01)

(52) U.S. Cl. ..... 313/477 R; 313/479; 220/2.1 A

(58) Field of Classification Search ..... 313/477 R, 313/461, 479; 220/2.1 A, 2.3 A
See application file for complete search history.

(56) References Cited

U.S. PATENT DOCUMENTS

| | | | | |
|---|---|---|---|---|
| 4,987,338 | A | 1/1991 | Itou et al. | |
| 5,686,787 | A * | 11/1997 | Itou et al. | 313/461 |
| 6,465,947 | B1 | 10/2002 | Tojo et al. | |
| 6,509,684 | B1 * | 1/2003 | Horie et al. | 313/479 |
| 6,555,953 | B1 | 4/2003 | Nishizawa et al. | |
| 6,559,590 | B1 * | 5/2003 | Mori et al. | 313/466 |
| 6,683,404 | B1 * | 1/2004 | Horie et al. | 313/478 |
| 6,771,017 | B1 * | 8/2004 | Nishizawa et al. | 313/479 |

FOREIGN PATENT DOCUMENTS

| | | |
|---|---|---|
| JP | 03-254048 | 11/1991 |
| JP | 2000-258625 | 9/2000 |
| JP | 2001-066420 | 3/2001 |

* cited by examiner

*Primary Examiner*—Ashok Patel
(74) *Attorney, Agent, or Firm*—Milbank, Tweed, Hadley & McCloy LLP

(57) ABSTRACT

The present invention enhances the quality of displayed images by enhancing the uniformity of the total transmissivity over the whole surface of a panel having a wavelength selective absorption layer imparted with gradation thus reducing the color difference of the body color. A transmissivity ratio between a peripheral portion and a central portion of a panel formed of tinted glass which differs in wall thickness between the peripheral portion and the central portion of a screen before the surface treatment is set to a value not greater than 60%, and the body color of the panel is set such that L*=30 to 40, a*=−8.5 to 1.5, b*=−5 to 5 at the center portion, L*=13.5 to 23.5, a*=−7.5 to 2.5, b*=−6.5 to 3.5 at the peripheral portion, where color difference is set to $\Delta a^*b^* \leqq 3$, and the film formed on the outer surface of the panel is constituted of a wavelength selective absorption layer and a conductive layer which is formed over the wavelength selective absorption layer.

2 Claims, 5 Drawing Sheets

COLOR CATHODE RAY TUBE

BACKGROUND OF THE INVENTION

1. Field of the Invention

The present invention relates to a color cathode ray tube, and more particularly to a so-called flat-panel-type color cathode ray tube having a panel in which an equivalent radius of curvature of an outer surface thereof which constitutes a screen is larger than an equivalent radius of curvature of an inner surface thereof.

2. Description of the Related Art

As a picture tube of a television receiver set and a monitor tube of a personal computer or the like, recently, a color cathode ray tube which is referred to as "flat panel type" or "planar panel type" has been popularly adopted. The flat panel type color cathode ray tube includes a vacuum envelope which is constituted of a panel which is provided with a phosphor layer on an inner surface thereof, a neck which houses an electron gun and a funnel which connects the panel and the neck. On the inner surface of the panel, in general, a phosphor layer is formed by applying phosphors of three colors consisting of red (R), green (G) and blue (B) in a mosaic shape or a stripe shape by coating. A color selection electrode (here, referred to as "shadow mask", hereinafter, the color selection electrode being explained as a shadow mask) is arranged close to the phosphor layer.

The shadow mask is of a self-standing shape-holding type which is formed by a press, wherein the shadow mask has a periphery thereof welded to a mask frame and is supported in a suspended manner on stud pins which are mounted on an inner wall of a skirt portion of the panel in an erected manner by way of suspension springs. Here, a magnetic shield is mounted on an electron gun side of the mask frame. A deflection yoke is exteriorly mounted on a transition region between the neck and the funnel of the vacuum envelope. By deflecting three modulated electron beams which are irradiated from the electron gun horizontally (X direction) and vertically (Y direction), the electron beams are scanned two-dimensionally on the phosphor layer thus reproducing images.

This flat panel type color cathode ray tube is, in view of a manufacturing cost and the easiness of manufacturing, configured such that the outer surface (also referred to as "image forming face", "screen", "face" or the like) of the panel has a large radius of curvature (equivalent radius of curvature), that is, the outer surface is made substantially flat, while the inner surface of the panel which constitutes a phosphor layer has a relatively small radius of curvature (equivalent radius of curvature) to an extent that a flat feeling of a display image is not damaged when the display screen is observed from the outer surface of the panel.

For example, with respect to a color cathode ray tube having a diagonal size of the screen of a nominal 29 type, a wall thickness of the panel is set to 12.5 mm at a center portion thereof and 25 mm at a peripheral portion thereof and hence, the difference in wall thickness is large between the center portion and the peripheral portion. Further, as a material which constitutes the panel, that is, as a panel base, a so-called tinted glass is used. Accordingly, the transmissivity of the panel is 51% at the center portion and 28% at the peripheral portion and hence, the difference is large. Accordingly, the brightness of the peripheral portion is approximately 50% of the brightness of the center portion whereby the brightness difference between the center portion and the peripheral portion when the image is displayed is large.

As a method which overcomes such a drawback, as disclosed in JP-A-2001-101984 (hereinafter referred to as "patent document 1"), there has been known a method in which a wavelength selective absorption layer which uses pigment or dye is applied to an outer surface of the panel so as to impart the gradation to the transmissivity of the wavelength. However, when the gradation is imparted using the wavelength selective absorption layer, coloring (saturation of color) of an appearance color (body color: depending on color of phosphor per se) of the screen in a state that the color cathode ray tube is not operated is strong and hence, the color difference between the center portion and the peripheral portion is increased and this is observed as the color irregularities whereby the quality of the color cathode ray tube is lowered. Here, as literatures which disclose other prior art relevant to the surface treatment of the panel, JP-A-2001-210260 (hereinafter referred to as "patent document 2"), JP-A-3-254048 (hereinafter referred to as "patent document 3"), JP-A-2000-258625 (hereinafter referred to as "patent document 4"), JP-A-2001-66420 (hereinafter referred to as "patent document 5"), JP-A-1-320742 (hereinafter referred to as "patent document 6") and the like can be named.

SUMMARY OF THE INVENTION

A color cathode ray tube including a panel to display image, a neck where electron gun is housed and a funnel which connect the panel and the neck, an outer surface of the panel having a film is formed substantially flat, an inner surface of the panel having a phosphor layer has a curvature, and a wall thickness differs between a center portion and a peripheral portion of the panel, wherein the panel formed of a tinted glass, a peripheral transmissivity ratio which is a ratio of transmissivities of the peripheral portion and the central portion of the panel before the film is set to a value not greater than 60%, and body color of the panel is set such that $L^*=30$ to 40, $a^*=-8.5$ to 1.5, $b^*=-5$ to 5 at the center portion, and $L^*=13.5$ to 23.5, $a^*=-7.5$ to 2.5, $b^*=-6.5$ to 3.5 at the peripheral portion, where color difference is set to $\Delta a^*b^* \leqq 3$, and the film formed on the outer surface of the panel is constituted of a wavelength selective absorption layer which is thick at the panel center portion and thin at the panel peripheral portion and a electrical conductive layer which is formed over the wavelength selective absorption layer, and the transmissivity ratio at the panel peripheral portion after the formation of the film is set to a value not less than 60% and the color difference is set to satisfy a following relationship.

the color difference $\Delta a^*b^*$ after the formation of the film $\leqq$ color difference $\Delta a^*b^*$ before the formation of the film

DESCRIPTION OF THE PREFERRED EMBODIMENTS

Figure 1A:
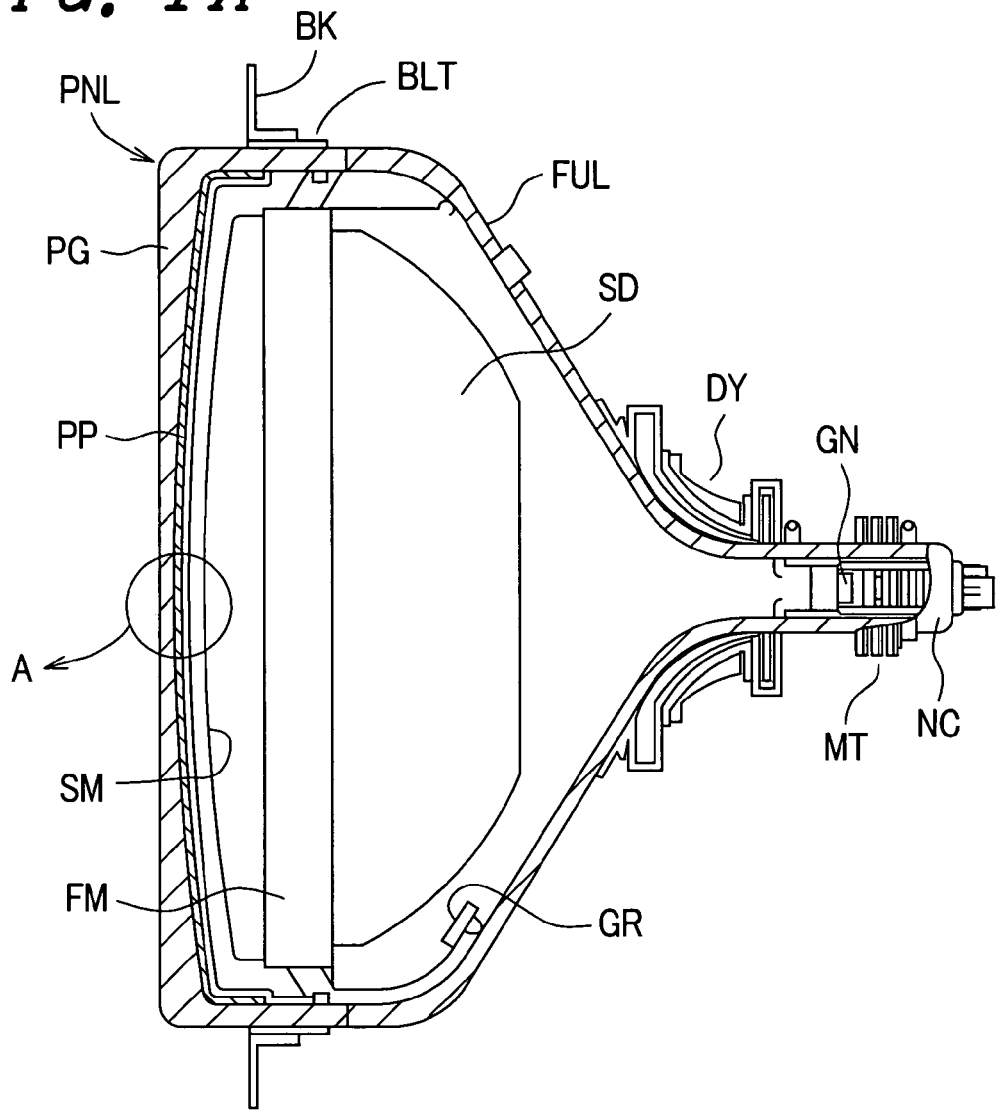
FIG. 1 is an explanatory view of one embodiment of a color cathode ray tube according to the present invention.

With respect to the color cathode ray tube in which a wavelength selective absorption layer which uses pigment or dye as a film is applied to the outer surface of the panel, by making the wavelength selective absorption layer have a uniform film thickness over the whole surface of the outer surface, the color irregularities do not cause any significant problems and the contrast can be enhanced. However, the larger the film thickness of the wavelength selective absorption layer, coloring of the body color is increased. On the other hand, by performing the surface treatment using the wavelength selective absorption layer having the gradation which increases the film thickness at the center portion of the panel having high transmissivity and decreases the film thickness at the peripheral portion having the low transmissivity, the total transmissivity of the panel and the whole-surface uniformity of the brightness can be enhanced.

However, when the wavelength selective absorption layer having the gradation is applied to the outer surface of the panel, coloring (saturation) of the center portion of the panel having the large film thickness becomes deep and coloring of the periphery becomes light. Accordingly, although the total transmissivity of the panel and the whole surface uniformity of the brightness can be enhanced, to focus on the body color, the color irregularities attributed to the difference in saturation is generated thus lowering the quality of the display images. Further, as disclosed in the patent document 6, with respect to the color cathode ray tube in which the body color is defined based on the transmissivities at a plurality of specific wavelengths and ratios among these wavelengths, when the film thickness differs in plane, the body color differs thus giving rise to color irregularities in appearance. Further, there has been a case that when the type of ambient light differs, the color irregularities become apparent. This is because that when the transmissivities of respective wavelengths differ delicately from each other due to the film thicknesses, the spectral of the ambient light also differs.

The present invention can provide the color cathode ray tube which can enhance the whole surface uniformity of the total transmissivity of a panel provided with a wavelength selective absorption layer having gradation and can enhance the quality of display images by decreasing the color difference of a body color.

The present invention is characterized in that by adopting an L* a* b* colorimetric system of a perceptively uniform color space with chromaticity which takes an isochromatic function into consideration, colors which human eyes perceive can be expressed quantatively, wherein by defining a range of the colors, even when the film thickness differs, the body color can be made uniform over the whole surface of the panel. Pigment or dye can be used as a wavelength selective absorption layer. To describe representative constitutions of the color cathode ray tube of the present invention, they are as follows.

(1) The color cathode ray tube of the present invention includes a panel formed of a tinted glass in which an outer surface to which a surface film for enhancing display quality is applied is formed substantially flat, an inner surface having a phosphor layer has a curvature, and a wall thickness differs between a center portion and a peripheral portion of a screen, wherein a peripheral transmissivity ratio which is a ratio of transmissivities of the peripheral portion and the central portion of the panel before the surface film is set to a value not greater than 60%, and body color of the panel is set such that $L^*=30$ to 40, $a^*=-8.5$ to 1.5, $b^*=-5$ to 5 at the center portion, and $L^*=13.5$ to 23.5, $a^*=-7.5$ to 2.5, $b^*=-6.5$ to 3.5 at the peripheral portion, where color difference is set to $\Delta a^*b^* \leqq 3$, and the film formed on the outer surface of the panel is constituted of a wavelength selective absorption layer which has a large film thickness at the panel center portion and a small film thickness at the panel peripheral portion and a charge prevention layer (conductive layer) which is formed over the wavelength selective absorption layer, and the transmissivity ratio at the panel peripheral portion after the formation of the film is set to a value not less than 60% and the color difference is set to satisfy a following relationship.

the color difference $\Delta a^*b^*$ after the formation of the film $\leqq$ color difference $\Delta a^*b^*$ before the formation of the film (2) In the above-mentioned conductive layer, assuming the transmissivity at a wavelength of 550 nm as T (550), the transmissivity at a portion of the panel center portion having the largest film thickness is expressed by $70\% \leqq T(550) \leqq 90\%$, and the chromaticity of transmitting light at the portion of the panel center portion having the largest film thickness when an incident light to the panel from an ambient light is set as a D65 standard light has the gradation expressed by $-1 \leqq a^* \leqq 2.5$.

$-4 \leqq b^* \leqq -0.5$

By forming the wavelength selective absorption layer on the outer surface of the panel such that the film thickness at the center portion of the screen is large and the film thickness at the peripheral portion is small, the high contrast can be realized whereby the whole surface uniformity of the total transmissivity can be enhanced. Further, by defining the T(550) of the transmissivity of the wavelength selective absorption layer at the center portion of the screen, the range of the gradation can be controlled so that the whole surface uniformity of the body color can be improved.

Although the manner of operation and advantageous effects brought about by the above-mentioned constitutions of the present invention are explained in detail in embodiments described hereinafter, the present invention is not limited to these manner of operation and advantageous effects and various modifications are conceivable without departing from the technical concept of the present invention.

Figure 1B:
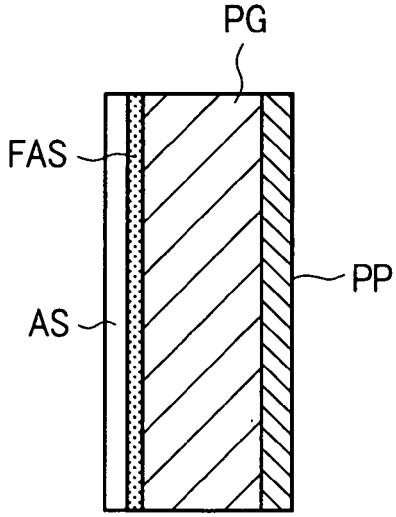

Preferred embodiments of the present invention are explained in detail in conjunction with drawings which show the embodiments. FIG. 1 is an explanatory view of one embodiment of a color cathode ray tube according to the present invention, wherein FIG. 1A is a cross-sectional view and FIG. 1B is an enlarged view of a portion A in FIG. 1A. In FIG. 1, reference symbol PNL indicates a panel of the color cathode ray tube of this embodiment. A funnel FUL has one end thereof joined to an open-end of a panel glass PG which constitutes the panel PNL and has a diameter thereof gradually narrowed. The funnel has a neck NC at another end. A vacuum envelope is formed of the panel PNL and the funnel FUL. The detail of the cross-sectional structure of the panel PNL is shown in FIG. 1B.

Further, a shadow mask SM which constitutes a color selection electrode is mounted in a suspended manner in the vicinity of a phosphor PP formed on an inner surface of the panel glass PG which constitutes the panel PNL. The shadow mask SM is held by a mask frame FM and is mounted on an inner wall of a skirt of the panel using a suspension mechanism. Further, on an electron gun side of the mask frame FM, a shield SD which shields electron beams which are irradiated from an electron gun GN and are deflected horizontally and vertically by a deflection yoke DY from an external magnetic field is mounted. Here, reference symbol GR indicates a getter, reference symbol MT indicates a correction magnetic device, reference symbol BLT indicates a reinforcing band, and reference symbol BK indicates a bracket for mounting.

As shown in FIG. 1A, although an outer surface of the panel glass PG is substantially flat, an inner surface of the panel glass PG has a curvature and hence, a wall thickness of the panel glass PG differs between a center portion and a peripheral portion thereof. As a result, the degree that light passes through the panel glass PG, that is, the panel transmissivity (hereinafter simply referred to as transmissivity) differs between the center portion and the peripheral portion whereby the difference arises with respect to the brightness of the emitted light at the time of operation. Table 1 shows the transmissivities of the center portion and the peripheral portion of the screen and the ratio between these transmissivities for every glass base (respective glass bases of clear, semi clear, gray and tint) of the panel. Here, Table 1 shows the result of measurement when the wall thickness of the panel glass is set to 12.5 mm at the center portion and 25.0 mm at the peripheral portion.

TABLE 1

| | | Panel transmissivity | | |
|---|---|---|---|---|
| | absorption coefficient k | panel transmissivity (%) | | periphery/center ratio |
| panel base | ($mm^{-1}$) | center | periphery | (%) |
| clear | 0.00578 | 84.85 | 78.93 | 93 |
| semi clear | 0.01290 | 77.62 | 66.06 | 85 |

TABLE 1-continued

| | | Panel transmissivity | | |
|---|---|---|---|---|
| | absorption coefficient k | panel transmissivity (%) | | periphery/center ratio |
| panel base | ($mm^{-1}$) | center | periphery | (%) |
| gray | 0.02191 | 69.35 | 52.74 | 76 |
| tinted | 0.04626 | 51.15 | 28.69 | 56 |

Assuming a 29 type flat cathode ray tube, the panel wall thickness is set to 12.5 mm at the center portion and 25.0 mm at the periphery. measuring wavelength: 546 nm As shown in Table 1, when the panel is formed of the tinted base, the panel transmissivity is 51.15% at the center portion of the screen and 28.69% at the periphery and hence, the (periphery/center) ration becomes 56%. Then, in the cathode ray tube which is assembled in which a phosphor screen is formed on the inner surface of the nominal 29 type flat panel type color cathode ray tube using the tinted base and the funnel and the neck housing the electron gun are assembled, the brightness is measured. It is found that the brightness of the peripheral portion is approximately 50% of the brightness of the center portion.

On an outer surface of the panel glass PG of the color cathode ray tube which is completed by applying exterior components such as a reinforcing band BLT, a deflection yoke DY, a correction magnetic device MT and the like, a film having the wavelength absorption property and the conductivity is formed. The structure of the film is, as shown in FIG. 1B, the two-layered structure which is formed on the outer surface of the panel glass PG and is constituted of an FAS (Filtered Anti Static Coating) layer and an AS (Anti Static Coating) layer.

Figure 2:
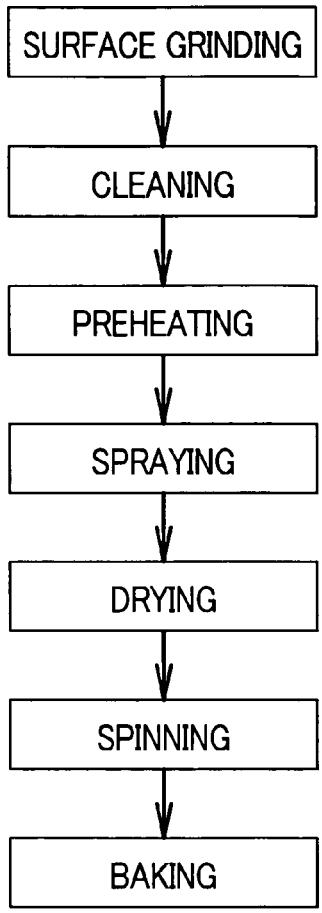
FIG. 2 is an explanatory view of a process for forming a film having the wavelength selective absorption property and the conductivity.

FIG. 2 is an explanatory view of a process for forming a film having the wavelength selective absorption property and the conductivity. First of all, an outer surface of the panel glass is ground, is cleaned and a preheating treatment is applied to the panel glass. The outer surface of the panel glass PG is coated with a first liquid (FAS film liquid) which is constituted of pigment particles having the wavelength selective absorption property, antimony containing tin oxide (ATO) particles having conductivity and silica by spraying and the FAS film liquid is dried. Further, to the dried film, a second liquid (an AS film liquid), which is formed of ATO particles and silica plied by spinning thus forming a two-layered film. The two-layered film is cured or hardened by the heating treatment. Due to such a process, the color cathode ray tube having the wavelength selective absorbing layer FAS and the electrical conductive layer AS is completed.

Figure 3:
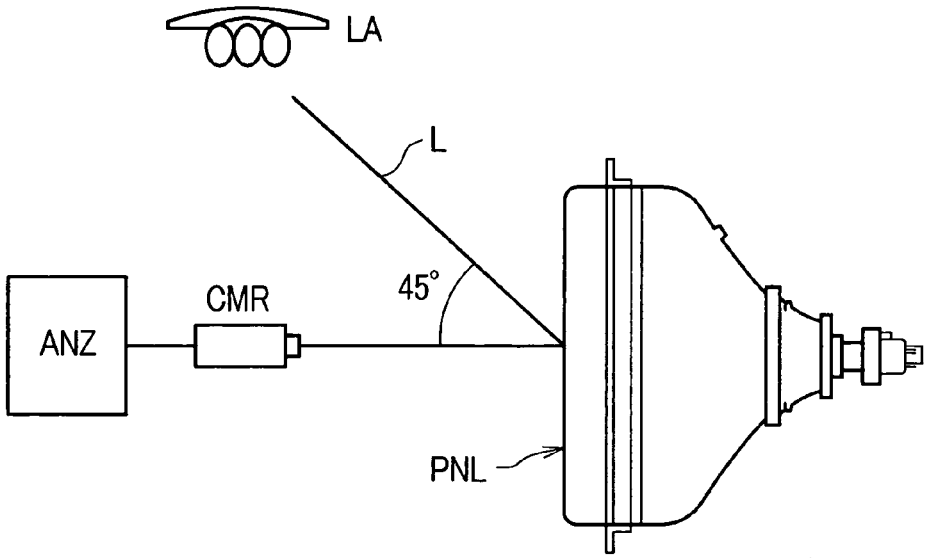
FIG. 3 is an explanatory view of an evaluation system of a body color to which a condition of 45° illumination-0° light reception defined by JIS Z8722 is applied.

Next, the evaluation method of body colors with respect to the panel of the flat panel type color cathode ray tube is explained. FIG. 3 is an explanatory view of an evaluation system of body colors when a condition of 45° illuminations-0° light reception defined by JIS Z8722 is adopted. To be more specific, a panel PNL of the color cathode ray tube is erected vertically, an illumination light source LA is arranged in the direction which is 45° oblique to a measuring point on the panel PNL, a measuring camera CMR is arranged in the direction perpendicular to the measuring point on the panel PNL, and a measuring apparatus ANZ for measuring a spectral intensity is connected to an output of the measuring camera CMR. Then, the illumination light L is incident on the panel PNL and the spectral intensity of the reflection light from the external surface of the panel PNL is measured. As the measuring apparatus ANZ, C-11 made by GAMMA SCIENTIFIC Inc. is used and a focal point of the measuring camera CMR is aligned with an interface between an inner surface of the panel PNL and a phosphor screen PP.

Assuming the spectral distribution of the illumination light as S(λ), the spectral reflection intensity of the phosphor surface when a diffusion surface of barium sulfate is used as the reference as R(λ), the spectral transmissivity of the panel as Tp(λ), and the spectral transmissivity of the film as Tf(λ), and 2° viewing field isochromatic functions as x(λ),y(λ) and z(λ), three stimulus values are expressed by following formulae. In the integration range, the wavelength (λ) is set to 380 to 780 nm.

$$X=K\int S(\lambda)R(\lambda)Tp(\lambda)^2Tf(\lambda)^2x(\lambda)d\lambda \quad (1)$$

$$Y=K\int S(\lambda)R(\lambda)Tp(\lambda)^2Tf(\lambda)^2y(\lambda)d\lambda \quad (2)$$

$$Z=K\int S(\lambda)R(\lambda)Tp(\lambda)^2Tf(\lambda)^2z(\lambda)d\lambda \quad (3)$$

$$K=100/\int S(\lambda)y(\lambda)d\lambda \quad (4)$$

$Tp(\lambda)^2$ is measured such that a panel portion of the cathode ray tube is cut out and, thereafter, $Tp(\lambda)^2$ is directly measured using a spectrophotometer (U-3400 made by Hitachi ltd.). R(λ) is obtained based on Y and the spectral diffraction strength of Tp(λ) in the measurement of the body color of the flat tube before the surface treatment. As S(λ), the standard light D 65 is set.

X, Y, Z which are obtained in this manner are converted into chromaticities defined by the CIE 1976 L*a*b* colorimetric system (JIS Z8729) and the body color is evaluated based on these chromaticities. Three stimulus values of the transmitting light of the film are obtained based on following formulae. The integration range is arranged where the wavelength (λ) is 380 to 780 nm. AS S(λ), the standard light D 65 is obtained.

$$X=K\int S(\lambda)Tf(\lambda)x(\lambda)d\lambda \quad (5)$$

$$Y=K\int S(\lambda)Tf(\lambda)y(\lambda)d\lambda \quad (6)$$

$$Z=K\int S(\lambda)Tf(\lambda)z(\lambda)d\lambda \quad (7)$$

$$K=100/\int S(\lambda)y(\lambda)d\lambda \quad (8)$$

Figure 4:
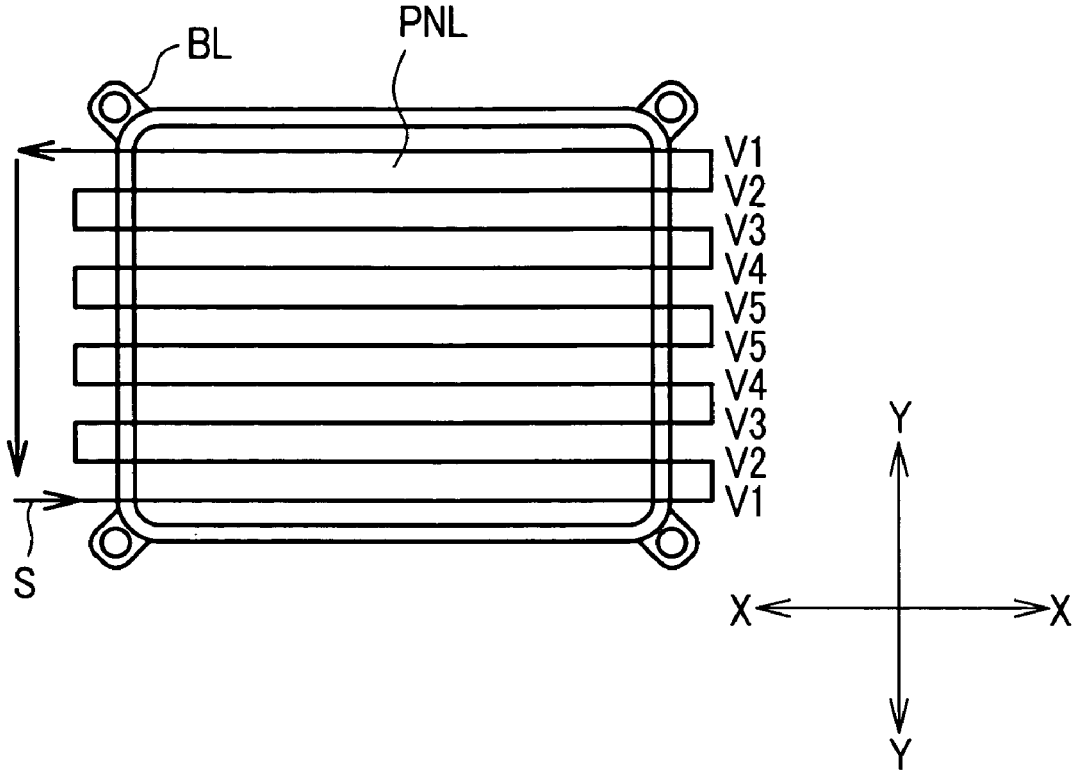
FIG. 4 is a schematic view for explaining a locus of scanning of a spray nozzle for forming the film on an outer surface of a panel.

Next, a specific example 1 of the film of this embodiment is explained. FIG. 4 is a schematic view for explaining a locus of scanning of a spray nozzle for forming a film on an outer surface of the panel. Contents of the liquid to be sprayed are as follows. That is, the FAS liquid having a following composition is applied to the outer surface of the panel by spraying.

| | |
|---|---|
| Quinacridone | 0.2 wt % |
| Phthalocyanine green | 0.04 wt % |
| Phthalocyanine blue | 0.02 wt % |
| Disazo yellow | 0.04 wt % |
| Carbon black | 0.2 wt % |
| Conductive minute particles (ATO) | 0.1 wt % |
| Silica | 0.3 wt % |
| Methanol | 30 wt % |
| Butylcellosolve | 15 wt % |
| Water | 5 wt % |
| Balance (polymer dispersing agent, hydrochloric acid, ketone-based solvent) | 19 wt % |

Here, BINKS model-61 is used as the spray nozzle, wherein an air flow rate is set to 200 L/min. The spray nozzle performs scanning at a position 200 mm above the outer surface of the panel such that a locus shown in FIG. 4 is obtained.

Figure 5:
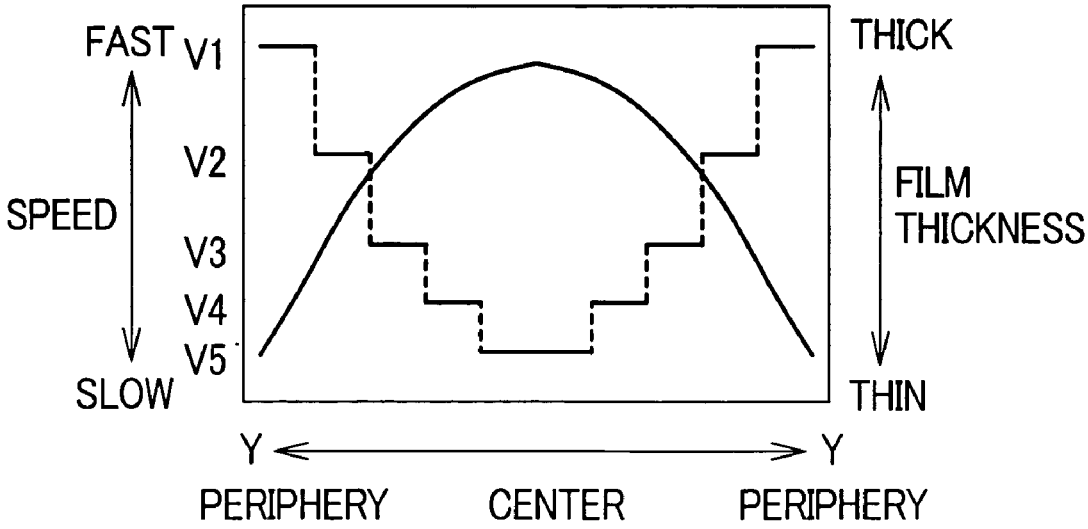
FIG. 5 is an explanatory view of a scanning speed of the spray nozzle.

FIG. 5 is an explanatory view of a scanning speed of the spray nozzle. The Y axis (Y—Y in FIG. 4) direction of the outer surface of the panel is taken on an axis of abscissas, the scanning speed (V1 to V5) of the spray nozzle is taken on an axis of left ordinate, and a film thickness of a coated film is taken on an axis of right ordinate. Here, in performing the coating using the spray nozzle, the film thickness of the FAS film is controlled by changing a coating amount in response to the difference of the scanning speed so as to impart the gradation to the transmissivity of the film thickness. In the scanning speed control shown in FIG. 5, the gradation is obtained on the outer surface of the panel of the cathode ray tube in the Y axis (Y—Y in FIG. 4) direction. The FAS film is applied by coating and thereafter is dried.

The AS liquid having following composition is applied by spin coating.

| | |
|---|---|
| Conductive minute particles (ATO) | 0.5 wt % |
| Silica | 0.5 wt % |
| Methanol | 10 wt % |
| Ethanol | 60 wt % |
| Butylcellosolve | 10 wt % |
| Water | 8 wt % |
| Balance (polymer dispersing agent, hydrochloric acid, ketone-based solvent) | 11 wt % |

After applying this AS liquid by spin coating, baking is performed successively and, thereafter, the two-layered film consisting of the FAS film and the AS film is hardened. Properties (transmissivity and transmitting color) of the hardened film are shown in Table 2.

TABLE 2

| Property of film of specific example 1 | |
|---|---|
| T(550) (%) | 80 |
| a* | +0.57 |
| b* | −2.63 |

As shown in Table 2, with respect to the film, the transmissivity is 80%, a* is +0.57 and b* is −2.63. The value L* is luminance at L* a* b* colorimetric system of CE 1976 L*a*b* colour space. The values a* and b* are psychometric chroma coordinates at L* a* b* colorimetric system of CIE 1976 L*a*b* colour space. The value Δa*b* is color difference.

Figure 6:
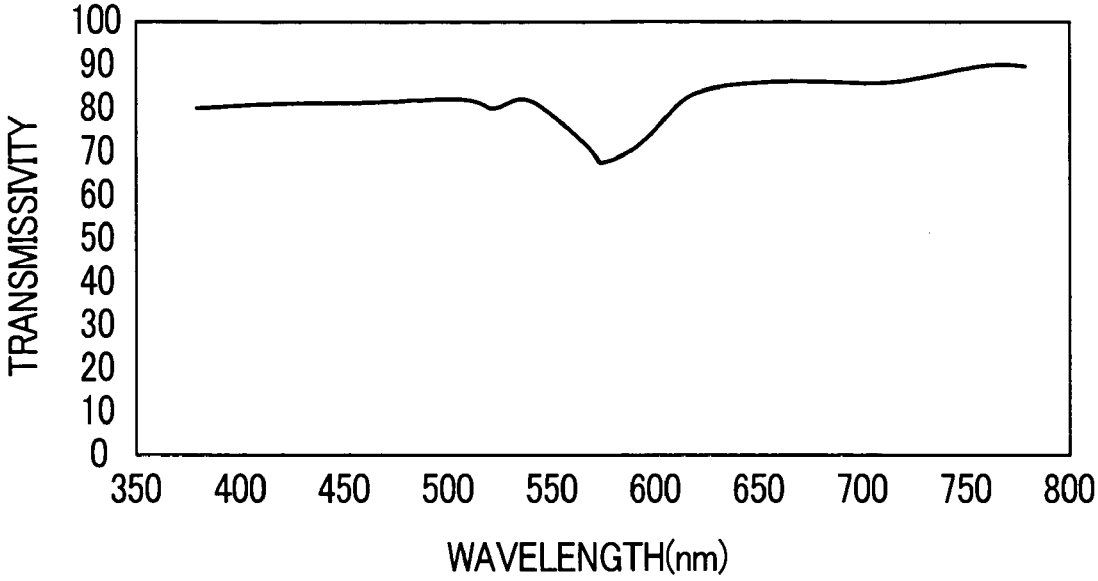
FIG. 6 is an explanatory view of the spectral transmissivity in the panel of a color cathode ray tube of a specific example 1 of this embodiment.

FIG. 6 is an explanatory view of the spectral transmissivity with respect to the panel of the color cathode ray tube according to the specific example 1 of this embodiment, wherein a wavelength (nm) is taken on an axis of abscissas and the transmissivity is taken on an axis of ordinates. Further, the properties of the color cathode ray tube after the surface treatment are shown in Table 3. In Table 3, "BCP" (brightness contrast performance: assuming a lowering rate of the reflection brightness as ΔRf and a lowering rate of the brightness as ΔB, expressed as $BCP=\Delta B/\sqrt{\Delta Rf}$) indicates an index of contrast.

TABLE 3

| Properties of cathode ray tube of specific example 1 | | Before surface treatment | | After surface treatment | |
|---|---|---|---|---|---|
| | | Center | Periphery | Center | Periphery |
| Panel transmissivity (%) (Note 1) | | 50.8 | 28.3 | 50.8 | 28.3 |
| Film transmissivity (%) (Note 1) | | — | — | 76.2 | 100 |
| Total transmissivity (%) (Note 1) | | 50.8 | 28.3 | 38.7 | 28.3 |
| Transmissivity ratio | | 100 | 56 | 100 | 73 |
| BCP | | 1 | 1 | 1.03 | 1 |
| Body color | L* | 34.72 | 18.46 | 27.07 | 18.46 |
| | a* | −3.40 | −2.22 | −2.48 | −2.22 |
| | b* | +0.11 | −1.49 | −1.98 | −1.49 |
| Δ a* b* | | 1.98 | | 0.47 | |
| Surface resistivity (Ω/□) | | Not less than $9 \times 10^{12}$ | Not less than $9 \times 10^{12}$ | $1 \times 10^{9}$ | $8 \times 10^{9}$ |

Note 1:
visual reflectance corrected by visibility

The color cathode ray tube having the properties shown in FIG. 2 exhibits the transmissivity ratio of 73% and the brightness ratio of 65% can be also obtained. The color difference Δa*b* of the body color is also reduced to 0.47 compared to the color difference before the surface treatment thus realizing the color cathode ray tube having the favorable uniformity over the whole surface of the body color.

Next, a specific example 2 of the film in this embodiment is explained. The composition of the liquid to be sprayed is as follows. That is,

| | |
|---|---|
| Quinacridone | 0.05 wt % |
| Phthalocyanine blue | 0.025 wt % |
| Carbon black | 0.52 wt % |
| Conductive minute particles (ATO) | 0.1 wt % |
| Silica | 0.3 wt % |
| Methanol | 30 wt % |
| Ethanol | 30 wt % |
| Butylcellosolve | 15 wt % |
| Water | 5 wt % |
| Balance (polymer dispersing agent, hydrochloric acid, ketone-based solvent) | 19 wt % |

That is, the FAS liquid having the above-mentioned composition is applied to the outer surface of the panel by spraying in the same manner as the specific example 1. After drying the FAS liquid, the AS liquid having the similar composition as the AS liquid in the specific example 1 is applied by spin coating and the two-layered film consisting of the FAS film and the AS film is hardened by baking. Properties (transmissivity and transmitting color) of the hardened film are shown in Table 4.

TABLE 4

| Property of film of specific example 2 | |
|---|---|
| T(550) (%) | 75.5 |
| a* | −0.92 |
| b* | −0.83 |

Figure 7:
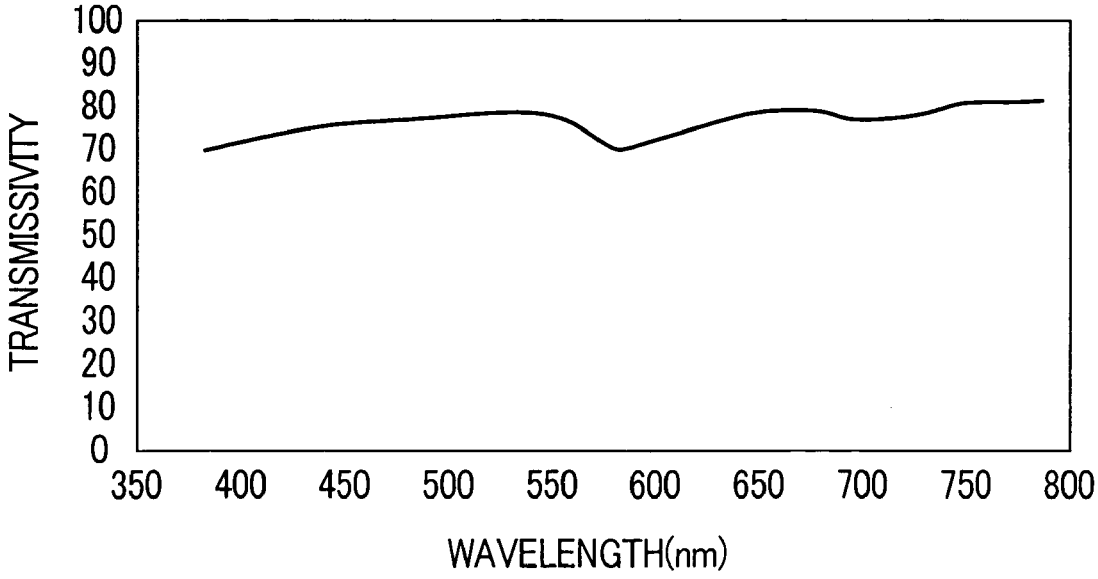
FIG. 7 is an explanatory view of the spectral transmissivity in the panel of a color cathode ray tube of a specific example 2 of this embodiment.

Further, FIG. 7 is an explanatory view of the spectral transmissivity with respect to the panel of the color cathode ray tube according to the specific example 2 of this embodiment, wherein a wavelength (nm) is taken on an axis of abscissas and the transmissivity is taken on an axis of ordinates. Further, the properties of the color cathode ray tube after the surface treatment are shown in Table 5.

TABLE 5

| Properties of cathode ray tube of specific example 2 | | After surface treatment | |
|---|---|---|---|
| | | Center | Periphery |
| Panel transmissivity (%) (Note 1) | | 50.8 | 28.3 |
| Film transmissivity (%) (Note 1) | | 73.5 | 100 |
| Total transmissivity (%) (Note 1) | | 37.3 | 28.3 |
| Transmissivity ratio | | 100 | 76 |
| BCP | | 1.01 | 1 |
| Body color | L* | 25.69 | 18.46 |
| | a* | −3.60 | −2.22 |
| | b* | −0.47 | −1.49 |
| Δ a* b* | | 1.71 | |
| Surface resistivity (Ω/□) | | $8 \times 10^{8}$ | $8 \times 10^{9}$ |

Note 1:
visual reflectance corrected by visibility

As shown in Table 4, with respect to the film, the transmissivity T(550) is 75.5%, a* is −0.92 and b* is −0.83. Further, as shown in Table 5, in this case, the color cathode ray tube having the properties exhibits the transmissivity ratio of 76% and the brightness ratio of 70%. The color difference Δa* b* of the body color is also reduced to 1.71 compared to the color difference before the surface treatment thus realizing the color cathode ray tube having the favorable uniformity over the whole surface of the body color.

Next, a specific example 3 of the film in this embodiment is explained. The composition of the liquid to be sprayed is as follows. That is,

| | |
|---|---|
| Quinacridone | 0.24 wt % |
| Phthalocyanine green | 0.11 wt % |
| Phthalocyanine blue | 0.02 wt % |
| Disazo yellow | 0.11 wt % |
| Conductive minute particles (ATO) | 0.1 wt % |
| Silica | 0.3 wt % |
| Methanol | 30 wt % |
| Ethanol | 30 wt % |
| Butylcellosolve | 15 wt % |
| Water | 5 wt % |
| Balance (polymer dispersing agent, hydrochloric acid, ketone-based solvent) | 19 wt % |

That is, the FAS liquid having the above-mentioned composition is applied to the outer surface of the panel by spraying in the same manner as the above-mentioned specific example. After drying the FAS liquid, the AS liquid having the similar composition as the AS liquid in the specific examples 1 and 2 is applied by spin coating and the two-layered film consisting of the FAS film and the AS film is hardened by baking. Properties (transmissivity and transmitting color) of the hardened film are shown in Table 6.

TABLE 6

| Properties of film of specific example 3 | |
|---|---|
| T(550) (%) | 75.3 |
| a* | 2.33 |
| b* | −3.79 |

Figure 8:
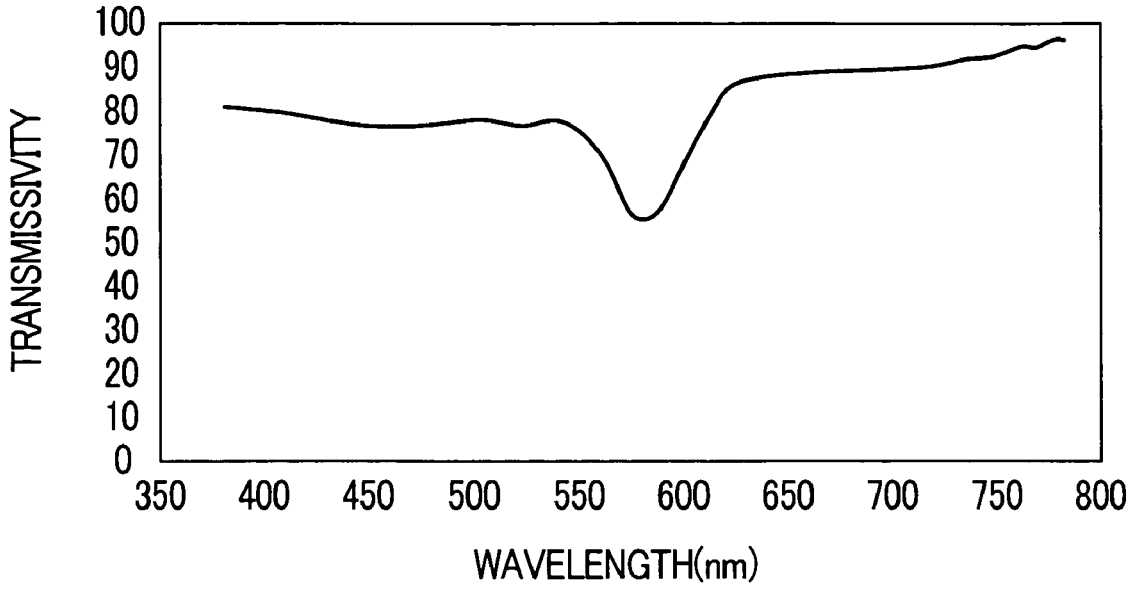
FIG. 8 is an explanatory view of the spectral transmissivity in the panel of a color cathode ray tube of a specific example 3 of this embodiment.

Further, FIG. 8 is an explanatory view of the spectral transmissivity with respect to the panel of the color cathode ray tube according to the specific example 3 of this embodiment, wherein a wavelength (nm) is taken on an axis of abscissas and the transmissivity is taken on an axis of ordinates. Further, the properties of the color cathode ray tube after the surface treatment are shown in Table 7.

TABLE 7

| Properties of cathode ray tube of specific example 3 | | After surface treatment | |
|---|---|---|---|
| | | Center | Periphery |
| Panel transmissivity (%) (Note 1) | | 50.8 | 28.3 |
| Film transmissivity (%) (Note 1) | | 69.9 | 100 |
| Total transmissivity (%) (Note 1) | | 35.5 | 28.3 |
| Transmissivity ratio | | 100 | 80 |
| BCP | | 1.05 | 1 |
| Body color | L* | 25.26 | 18.46 |
| | a* | −0.82 | −2.22 |
| | b* | −2.56 | −1.49 |
| Δ a* b* | | 1.77 | |
| Surface resistivity (Ω/□) | | $3 \times 10^9$ | $8 \times 10^9$ |

Note 1:
visual reflectance corrected by visibility

As shown in Table 6, with respect to the film, the transmissivity T(550) is 75.3%. Further, as shown in Table 7, in this case, the color cathode ray tube having the properties exhibits the transmissivity ratio of 80% and the brightness ratio of 72%. The color difference Δa* b* of the body color is also reduced to 1.77 compared to the color difference before the surface treatment thus realizing the color cathode ray tube having the favorable uniformity over the whole surface of the body color.

Here, to explain the advantageous effect of the above-mentioned specific examples 1 to 3 of the film of this embodiment, a comparison example is provided. The composition of the liquid to be sprayed is as follows. That is,

| | |
|---|---|
| Quinacridone | 0.2 wt % |
| Phthalocyanine blue | 0.01 wt % |
| Disazo yellow | 0.06 wt % |
| Conductive minute particles (ATO) | 0.1 wt % |
| Silica | 0.3 wt % |
| Methanol | 30 wt % |
| Ethanol | 30 wt % |
| Butylcellosolve | 15 wt % |
| Water | 5 wt % |
| Balance (polymer dispersing agent, hydrochloric acid, ketone-based solvent) | 19 wt % |

That is, the FAS liquid having the above-mentioned composition is applied to the outer surface of the panel by spraying in the same manner as the specific examples. After drying the FAS liquid, the AS liquid having the similar composition as the AS liquid in the specific examples is applied by spin coating and the two-layered film consisting of the FAS film and the AS film is hardened by baking. Properties (transmissivity and transmitting color) of the hardened film are shown in Table 8.

TABLE 8

| Properties of film of comparison example | |
|---|---|
| T(550) (%) | 80.0 |
| a* | +4.14 |
| b* | −5.67 |

Figure 9:
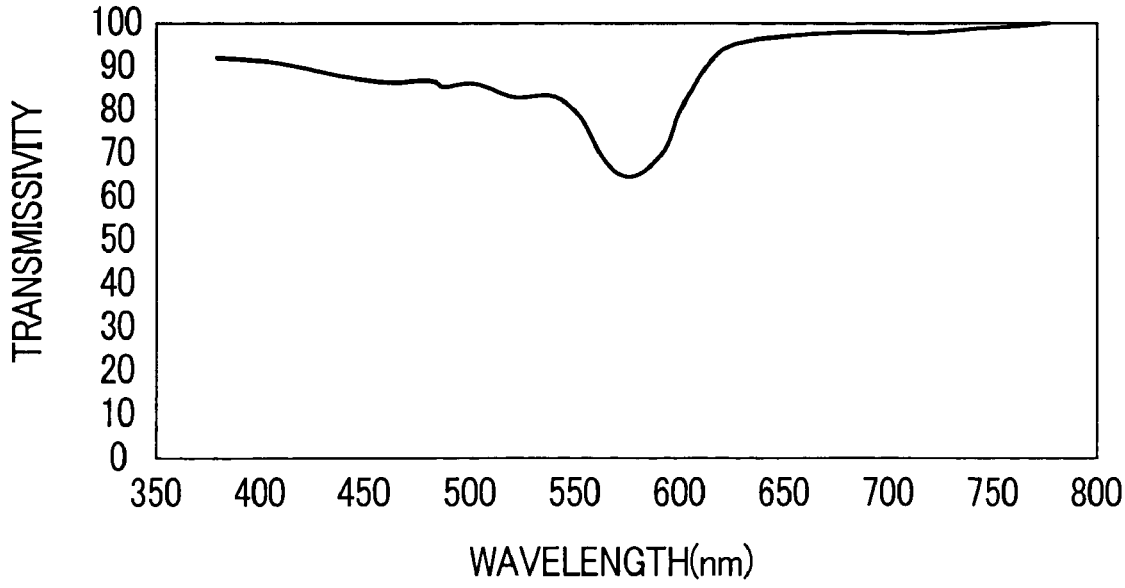
FIG. 9 is an explanatory view of the spectral transmissivity in a panel of a color cathode ray tube of a comparison example which is served for comparison with the color cathode ray tube according to the embodiment of the present invention.

Further, FIG. 9 is an explanatory view of the spectral transmissivity of the panel of the color cathode ray tube of the comparison example which is served for comparison with the panel of the color cathode ray tube according to the embodiment of the present invention. In the drawing, a wavelength (nm) is taken on an axis of abscissas and the transmissivity is taken on an axis of ordinates. Further, the properties of the color cathode ray tube after the surface treatment are shown in Table 9.

TABLE 9

| Properties of cathode ray tube of comparison example | | After surface treatment | |
|---|---|---|---|
| | | Center | Periphery |
| Panel transmissivity (%) (Note 1) | | 50.8 | 28.3 |
| Film transmissivity (%) (Note 1) | | 75.9 | 100 |
| Total transmissivity (%) (Note 1) | | 38.5 | 28.3 |
| Transmissivity ratio | | 100 | 73.5 |
| BCP | | 1.07 | 1 |
| Body color | L* | 27.41 | 18.46 |
| | a* | +0.63 | −2.22 |
| | b* | −4.26 | −1.49 |
| Δ a* b* | | 3.98 | |
| Surface resistivity (Ω/ □) | | $3 \times 10^9$ | $8 \times 10^9$ |

Note 1:
visual reflectance corrected by visibility

The spectral transmissivity of the film shown in FIG. 9 is similar to the spectral transmissivity of the film shown in FIG. 8. That is, when the transmissivity T(550) of the film of the color cathode ray tube is 80.0% as shown in Table 8, the transmissivity ratio becomes 73.5% and the brightness ratio of 67% can be also obtained as shown in Table 9. However, a* becomes +4.14 and b* becomes −5.67. Accordingly, the color difference Δa* b* of the body color becomes large, that is, 3.98 and hence, the red component at the center of the screen is increased whereby the irregularities of the body color becomes apparent.

Here, although the explanation has been made by taking the nominal 29 type flat panel type color cathode ray tube as an example, the present invention is applicable to the flat panel type color cathode ray tube and a flat display tube having other size in the same manner. Further, the pigment or the dye which can be used in the present invention are not limited to the pigment and the dye used in the above-mentioned specific examples.

Table 10 is an overall table which compares surface quality of the color cathode ray tube according to the present invention and the surface quality of the color cathode ray tube of the prior art.

TABLE 10

Prior art and present invention

| No. | Technique | FAS (Note 1) | Gradation (Note 2) | Panel transmissivity (Note 3) | Comment on color irregularities of body color | Evaluation of color irregularities (Note 4) |
|---|---|---|---|---|---|---|
| 1 | Prior art 1 (JP-A-3-254048 and others) | Present | Non-present | Uniform (round panel) | Although coloring of FAS is present, color irregularity is not present because of uniformity over the whole surface. | Good |
| 2 | Prior art 2 (JP-A-2001-101984) | Non-present | Present | Non-uniform (flat panel) | Since the transmissivity gradation is imparted with carbon black or silver-based black pigment (achromatic color), no color irregularity is present even when the film thickness differs | Good |
| 3 | Prior art 1 + Prior art 2 | Present | Present | Non-uniform (flat panel) | Since the film thickness differs with the color film of the FAS, the color irregularities are present | Bad |
| 4 | Present invention | Present | Present | Non-uniform (flat panel) | The present invention can cope with color irregularities by defining the transmissivity spectral of FAS using T(550) and chromaticity. | Good |

(Note 1)
FAS: it is possible to enhance the contrast without substantially lowering the brightness of the cathode ray tube with the wavelength selective absorption layer. Chromatic color film
(Note 2)
Gradation: by uniformly adjusting the difference in transmissivity between the center and the periphery of the panel surface using the transmissivity of the film, the uniformity of brightness of the whole surface of the panel can be enhanced. Achromatic color film
(Note 3)
Panel transmissivity: since both of the outer surface and the inner surface of the conventional panel have the curvatures, the transmissivity is uniform. Since the flat panel has the flat outer surface and the inner surface having the curvature, the transmissivity becomes non-uniform over the whole surface.
(Note 4)
Color irregularities: irregularities of body color, good: practically usable, bad: practically non-usable.

In Table 10, the color cathode ray tube of No. 1 constitutes the prior art of the above-mentioned "patent document 3" and other patent documents, the color cathode ray tube of No. 2 constitutes the prior art of the above-mentioned "patent document 1", the color cathode ray tube of No. 3 constitutes the prior art which is the combination of "patent document 1" and "patent document 2", and the color cathode ray tube of No. 4 constitutes the present invention. The detailed constitution and the result of evaluation are described in Table 10.

According to the present invention, by defining the transmitting color when the standard light D65 is allowed to transmit as the spectral diffraction transmissivity of the film shown in FIG. 6 to FIG. 8, it is possible to provide the flat panel type color cathode ray tube which can simultaneously exhibit the uniformity of brightness, the high contrast, the conductive and the uniformity of body color.

Conventionally, the transmitting spectral has been designated using the transmitting light constituted of light having a specific wavelength. However, to include the interaction within a reproducible wavelength range of 380 nm to 780 nm, the infinite number of combinations is considered with respect to the designated wavelength and hence, the designation of the substantially explicit range of transmissivity is difficult. To the contrary, according to the present invention described heretofore, the transmitting spectral can be expressed by the chromaticity of the transmitting light without using the transmissivity and hence, the range of transmitting spectral can be definitely determined.

According to the range of the chromaticity explained in view of the embodiments, coloring of the panel glass caused by the difference in wall thickness can be improved by adjusting the film thickness of FAS and hence, the uniformity of the body color over the whole surface can be enhanced whereby it is possible to provide the color cathode ray tube which can enhance the grade or the quality of the display device by reducing the color difference of the body color.

What is claimed is:

1. A color cathode ray tube including a panel to display image, a neck where electron gun is housed and a funnel which connect the panel and the neck, an outer surface of the panel having a film is formed substantially flat, an inner surface of the panel having a phosphor layer has a curvature, and a wall thickness differs between a center portion and a peripheral portion of the panel, wherein the panel formed of a tinted glass, a peripheral transmissivity ratio which is a ratio of transmissivities of the peripheral portion and the central portion of the panel before the film is set to a value not greater than 60%, and body color of the panel is set such that $L^*=30$ to 40, $a^*=^{-}8.5$ to 1.5, $b^*=^{-b\ to}$ 5 at the center portion, and $L^*=13.5$ to 23.5, $a^*=^{-}7.5$ to 2.5, $b^*=^{-}6.5$ to 3.5 at the peripheral portion, where color difference Δa*b* is set at Δa*b*=<3, and the film formed on the outer surface of the panel is constituted of a wavelength selective absorption layer which is thick at the panel center portion and thin at the panel peripheral portion and an electrical conductive layer which is formed over the wavelength selective absorption layer, and the transmissivity ratio at the panel peripheral portion after the formation of the film is set to a value not less than 60% and the color difference is set to satisfy a following relationship the color difference Δa*b* after the formation of the film ≦ color difference Δa*b* before the formation of the film, where L* is luminance at L* a* b* colorimetric system of CIE 1976 L*a*b* colour space, a* and b* are psychometric chroma coordinates at L* a* b* colorimetric system of CIE 1976 L*a*b* colour space.

2. A color cathode ray tube according to claim 1, wherein with respect to the electronic conductive layer, the transmissivity at the panel center portion is expressed by 70%≦T(550)≦90% and where T (550) is the transmissivity at a wavelength of 550nm, the chromaticity of transmitting light at the panel center portion when an incident light to the panel from an ambient light is set as a D65 standard light has the gradation expressed by ⁻1≦a*≦2.5

⁻4≦*≦0.5.

* * * * *